US008311186B2

(12) United States Patent
Perkins

(10) Patent No.: US 8,311,186 B2
(45) **Date of Patent: *Nov. 13, 2012**

(54) BI-DIRECTIONAL DISPENSER CATHODE

(75) Inventor: Luke T. Perkins, Plainsboro, NJ (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1149 days.

This patent is subject to a terminal disclaimer.

(21) Appl. No.: 11/957,183

(22) Filed: Dec. 14, 2007

(65) Prior Publication Data

US 2009/0153010 A1 Jun. 18, 2009

(51) Int. Cl.
*H05G 1/52* (2006.01)
*H05H 11/00* (2006.01)

(52) U.S. Cl. ..... 378/113; 378/134; 378/136; 315/504

(58) Field of Classification Search ..... 315/46, 315/94, 96–97, 112, 500–507; 313/270, 313/310, 337, 344, 346 R, 346 DC, 628; 378/113, 134, 136, 142

See application file for complete search history.

(56) References Cited

U.S. PATENT DOCUMENTS

| | | | | |
|---|---|---|---|---|
| 3,015,032 | A | 12/1961 | Hoyer et al. | |
| 3,321,625 | A | 5/1967 | Wahl | |
| 3,546,512 | A | 12/1970 | Fentrop | |
| 3,756,682 | A | 9/1973 | Frentrop | |
| 3,818,260 | A * | 6/1974 | Elfe et al. | 313/299 |
| 3,949,232 | A | 4/1976 | Langford et al. | |
| 3,975,689 | A | 8/1976 | Geizer et al. | |
| 3,996,473 | A | 12/1976 | Culver | |
| 4,310,775 | A * | 1/1982 | Heynisch | 313/346 R |
| 4,577,156 | A | 3/1986 | Kerst | |
| 4,600,838 | A | 7/1986 | Steinman et al. | |
| 4,721,853 | A | 1/1988 | Wraight | |
| 4,794,792 | A | 1/1989 | Flaum et al. | |
| 4,823,044 | A | 4/1989 | Falce | |
| 5,077,530 | A | 12/1991 | Chen | |
| 5,122,662 | A | 6/1992 | Chen et al. | |
| 5,126,623 | A * | 6/1992 | Choi | 313/346 DC |
| 5,293,410 | A | 3/1994 | Chen et al. | |
| 5,313,504 | A | 5/1994 | Czirr | |

(Continued)

FOREIGN PATENT DOCUMENTS

EP 0158417 A2 10/1985

OTHER PUBLICATIONS

Ellis et al., Well Logging for Earth Scientists, Springer, 2nd edition, 2007, pp. 345-379.

(Continued)

*Primary Examiner* — Tung X Le

(57) ABSTRACT

A multi-directional dispenser cathode has a cathode body that supports a plurality of electron emitters which spanning open portions of the cathode body. Each electron emitter has an inward facing surface and an outward facing surface wherein the inward facing surfaces and an interior wall of the body define an interior volume that contains a heater. To selectively accelerate emitted electrons, an electrically distinct biasing electrode is in spaced relationship to the outward facing surface of each electron emitter and coupled to a biasing power supply effective to provide an intermittent positive voltage potential to the biasing electrode. The distinct biasing electrodes are provided with a positive voltage potential at different times thereby causing an intermittent burst of electrons. Among the applications for intermittent bursts of accelerated electrons are to generate radiation from a particle accelerator.

28 Claims, 6 Drawing Sheets

U.S. PATENT DOCUMENTS

| | | | | |
|---|---|---|---|---|
| 5,319,314 | A | 6/1994 | Chen | |
| 5,326,970 | A * | 7/1994 | Bayless | 250/269.1 |
| 5,426,409 | A | 6/1995 | Johnson | |
| 5,525,797 | A | 6/1996 | Moake | |
| 5,666,022 | A * | 9/1997 | Deckers et al. | 313/346 DC |
| 5,745,536 | A | 4/1998 | Brainard et al. | |
| 5,793,157 | A * | 8/1998 | Takakura et al. | 313/446 |
| 5,804,820 | A | 9/1998 | Evans et al. | |
| 5,912,460 | A | 6/1999 | Stoller et al. | |
| 6,121,850 | A | 9/2000 | Ghoshal | |
| 6,201,851 | B1 | 3/2001 | Piestrup et al. | |
| 6,376,978 | B1 | 4/2002 | Leung et al. | |
| 6,441,569 | B1 | 8/2002 | Janzow | |
| 6,600,257 | B2 * | 7/2003 | Gaertner et al. | 313/346 R |
| 6,713,976 | B1 | 3/2004 | Zumoto et al. | |
| 6,771,014 | B2 * | 8/2004 | Longo et al. | 313/346 DC |
| 6,870,894 | B2 | 3/2005 | Leung et al. | |
| 6,925,137 | B1 | 8/2005 | Forman | |
| 7,062,017 | B1 * | 6/2006 | Runnoe | 378/136 |
| 7,073,378 | B2 | 7/2006 | Smits et al. | |
| 7,148,613 | B2 | 12/2006 | Dally et al. | |
| 7,916,838 | B2 * | 3/2011 | Perkins et al. | 378/113 |
| 2003/0234355 | A1 | 12/2003 | Leung et al. | |
| 2004/0022361 | A1 * | 2/2004 | Lemaitre | 378/138 |
| 2005/0117705 | A1 * | 6/2005 | Morrison et al. | 378/136 |
| 2005/0225224 | A1 * | 10/2005 | Dally et al. | 313/361.1 |
| 2006/0261759 | A1 | 11/2006 | Chen et al. | |
| 2009/0066269 | A1 | 3/2009 | Ernst | |
| 2009/0072767 | A1 | 3/2009 | Ernst | |
| 2009/0157317 | A1 | 6/2009 | Case | |

OTHER PUBLICATIONS

Afonin et al., Abstract of "A compact pulsed electron accelerator with a independent power supply," Instruments and Experimental Techniques, 1973, vol. 16(5): pp. 1-2.

Jung et al., "Development of a compact helicon ion source for neutron generators," Review of Scientific Instruments, May 2004 (Presented 2003), vol. 75(5): pp. 1878-1880.

Kim et al., "Development of D-D neutron generator," Nuclear Instruments and Methods in Physics Research B, 2005, vol. 241: pp. 917-920.

Rhee et al., Abstract and Complete Article of "Circuit description of pulsed power systems," IEEE Particle Accelerator Conference, Accelerator Science and Technology, 1989, vol. 33: pp. 1-2 (Abstract); 1954-1956 (Full Article).

* cited by examiner

BI-DIRECTIONAL DISPENSER CATHODE

CROSS REFERENCE TO RELATED APPLICATION(S)

This patent application is related to commonly owned U.S. patent application Ser. No. 11/957228 titled "Betatron Bi-Directional Electron Injector", Perkins et al., filed on Dec. 14, 2007, and U.S. patent application Ser. No. 11/957090, Luke Perkins, titled "Multiple Target Sealed Tube Ion Accelerator", filed on Dec. 14, 2007.

BACKGROUND OF THE INVENTION

1. Field of the Invention

The invention generally relates to a cathode for emitting electrons. More particularly, a dispenser cathode having at least two electron emitting surfaces oriented in different directions.

2. Background of the Invention

A combination of an electron source and energized electrode grid generates ionizing electrons that may be used in conventional hot cathode based ion sources employed in radiation generators, such as neutron generators or as a source for electrons in x-ray-producing accelerators. These devices are typically uni-directional whereby the source of electrons is at one end of an acceleration column and a target from which emanates the desired radiation, for example neutrons or x-rays, is at the opposing end. There are several possible sources of free energetic electrons for ion sources. The most common source is via the thermionic process in which when a metallic surface is heated, electrons are freed with thermal energies. The simplest source of thermionic electrons is a heated tungsten filament. By passing a current through the filament, ohmic heating occurs and electrons are released. When a biasing voltage is applied to the filament, the freed electrons can accelerate into a nearby volume. Such a simple filament poses some critical issues including: the source of electrons is distributed in space along the surface of the heating filament (i.e., not a point source) and is dependent on the temperature and localized accelerating (extracting) field; and the filament is susceptible to ion bombardment and thus sputtering, limiting its useful life.

A dispenser or hot cathode mitigates most of the drawbacks of a filament by providing a planar surface from which electrons are emitted. A typical dispenser cathode includes a tubular body containing a heater coil embedded in a ceramic matrix. The container or can may have any desired cross-section, such as square or round. At one end of the tube is a disk of an emitter material, typically porous tungsten with a work function lowered by a suitable doping process. At the other end of the tube is the ceramic matrix with outwardly extending leads. The robustness of the dispenser cathode design is achieved at the expense of the total operating power when compared to a simple filament. Indeed, the added thermal mass of the body, though, makes for a more uniform temperature of the emitter surface, therefore results in more uniform electron emission, thus requiring greater heating power. The thermionically emitted electrons can be accelerated into a beam by creating an electrostatic field, such as an electrode, for example a grid, in front of the emitting surface.

A dispenser cathode is disclosed in U.S. Pat. No. 4,823,044 to Falce. The dispenser cathode includes a cup shaped reservoir containing a pellet that is a porous mixture of tungsten doped with barium calcium aluminate. An outward facing surface of the pellet is sealed with a porous sintered tungsten plug. A resistance coil located adjacent the reservoir provides heat to effect emission of electrons.

A common feature of most conventional radiation generators is uni-directional particle acceleration. Such basic particle accelerators include, at a minimum, a source of charged particles, an acceleration column for transport of charged particles and a target. In the case of neutron and x-ray generators, the accelerated particles are made to collide with the target which becomes the source of radiation. In some specific configurations of accelerating fields, it is of interest to make use of two or more directions dictated by either or both the physical geometry and the orientation of the accelerating field. For these instances, the sources of charged particles provide charges which are acceptable by each and all directions of the accelerating field. For example, U.S. Pat. No. 4,577,156 to Kerst discloses two Betatron tubes, one above the other, and each tube having a separate electron injector and target. A first injector injects a beam of electrons into the first tube in a first direction when an accelerating flux is changing from its positive maximum to its negative maximum. The second injector then injects a beam of electrons into the second tube in an opposing second direction when the accelerating flux is changing from its negative maximum to its positive maximum. A single tube embodiment having two injectors spaced apart in the same tube is also disclosed.

The U.S. Pat. No. 7,148,613 to Dally, et al. discloses a thermionic emission cathode having circumferential emitters surrounding a central heater such that the cathode emits electrons in up to 360° about the central heater. An electron impervious shield surrounds the cathode and has windows that enable collimated emission of electrons in desired directions.

For applications such as a pulsed Betatron, there remains a need for a common source of electrons that can be provided in controlled bursts in multiple directions. Such a device could improve the efficiency of the Betatron. For applications such as a multiple point source grounded target neutron generator, there remains a need for a common source of electrons that can be provided in controlled bursts in multiple directions. Such a device could extend the measurement capability of the neutron generator.

SUMMARY OF THE INVENTION

According to an embodiment of the invention, the invention can include a multi-directional dispenser cathode having a body that supports a plurality of electron emitters each spanning open portions of the cathode body. Each electron emitter can have an inward facing surface and an outward facing surface where the inward facing surfaces and an interior wall of the body define an interior volume that contains a heater. To selectively accelerate emitted electrons, an electrically distinct biasing electrode, for example a grid (or biasing grid), can be in spaced relationship to the outward facing surface of each electron emitter and coupled to a biasing power supply effective to provide an intermittent (when pulsed is desired) positive voltage potential, relative to the cathode, to the biasing grid. The distinct biasing grids can be provided with the positive voltage potential at different times thereby causing an intermittent burst of electrons that is also independently spatially directed.

One application for intermittent bursts of accelerated electrons is to generate products from a particle accelerator. For example, the electrons may impact a target and generate x-rays for use in imaging a living body or determining density of earth formations. The electrons may ionize a gas, the ions are drawn into a beam, accelerated and made to impinge a target generating neutrons.

According to an aspect of the invention, the invention can include a first electrically distinct biasing electrode in spaced relationship to an outward facing surface of a first electron emitter of the plurality of electron emitters and a second electrically distinct biasing electrode in spaced relationship to an outward facing surface of a second electron emitter of the plurality of electron emitters. The invention may also include the first electrically distinct biasing electrode coupled to at least one biasing power supply and the second electrically distinct biasing electrode that is coupled to at least one other biasing power supply, so as to be effective to provide a positive voltage potential, relative to the cathode body to the respective the first and the second electrically distinct biasing electrodes.

According to an aspect of the invention, the invention can include the heater being a metal coil that repeatedly heats to a temperature in excess of 900° C. when an effective electric current passes therethrough. It is possible that at least one of the plurality of electron emitters can be a porous tungsten matrix doped with a low work function material. Further, the metal coil may receive the effective electric current through leads that extend through the cathode body, wherein the cathode body can be a refractory metal and electrically isolated from the leads by a dielectric.

According to an embodiment of the invention, the invention can include a betatron having a passageway disposed in a cyclical magnetic field. The Betatron can comprise of a dispenser cathode disposed within the passageway that has a plurality of electron emitters. Further, a target that is effective to generate x-rays when impacted by accelerated electrons.

According to an aspect of the invention, the invention can include the dispenser cathode can include a first electrically distinct biasing grid in spaced relationship to an outward facing surface of a first electron emitter of the plurality of electron emitters and a second electrically distinct biasing grid in spaced relationship to an outward facing surface of a second electron emitter of the plurality of electron emitters. Further, the first and the second electrically distinct biasing electrodes are each coupled to a biasing power supply effective to provide a positive voltage potential relative to the cathode body to the respective the first and the second electrically distinct biasing electrodes.

According to an aspect of the invention, the invention can include a switch coupled to the biasing power supply effective to cause the positive voltage potential to be intermittently provided to each of the first and the second electrically distinct biasing electrodes. Further, the dispenser cathode has the two electron emitters disposed along a longitudinal axis of the cathode body. Further still, the switch can be synchronized with the cyclical magnetic field whereby electrons generated from the first electron emitter are accelerated into the passageway during an increasing positive portion of the cyclical magnetic field and electrons generated from the second electron emitter are accelerated into the passageway during an increasing negative portion of the cyclical magnetic field.

According to an embodiment of the invention, the invention includes a particle accelerator. The particle accelerator can comprise of a body defining an interior volume and a dispenser cathode disposed within a passageway having a plurality of electron emitters. Further, the particle accelerator can include a target effective to generate at least one product when impacted by accelerated particles.

According to an aspect of the invention, the invention can include the dispenser cathode to include a first electrically distinct biasing electrode in spaced relationship to an outward facing surface of a first electron emitter of the plurality of electron emitters and a second electrically distinct biasing electrode in spaced relationship to an outward facing surface of a second electron emitter of the plurality of electron emitters.

According to an embodiment of the invention, the invention includes a method for the operation of a Betatron. The method can include the steps of providing a Betatron having a passageway disposed in a cyclical magnetic field, with a dispenser cathode having a first electron emitter and a second electron emitter of a plurality of electron emitters disposed within the passageway. The method can also includes the step of an electrically distinct biasing grid in spaced relationship to an outward facing surface of each of the first and the section electron emitters, and a target effective to generate x-rays when impacted by accelerated electrons. Further, the method includes the steps of heating the first and the second electron emitters to a temperature effective to cause an emission of electrons. Further, the method includes the steps of intermittently applying a positive voltage relative to the cathode body to the electrically distinct biasing grids thereby accelerating emitted electrons.

According to an aspect of the invention, the invention can include the step of intermittently applying the positive voltage is synchronized with the cyclical magnetic field. Further, the synchronization causes electrons generated from the first electron emitter to be accelerated into the passageway during an increasing positive portion of the cyclical magnetic field and electrons generated from the second electron emitter to be accelerated into the passageway during an increasing negative portion of the cyclical magnetic field.

According to an embodiment of the invention, the invention includes a method for the operation of a particle accelerator. The method can include providing a particle accelerator body having an interior volume a dispenser cathode having a first and a second electron emitter disposed within the interior volume, an electrically distinct biasing grid in spaced relationship to an outward facing surface of each of the first and the second electron emitter, and a target effective to generate at least one product when impacted by accelerated particles. Further, the method can include the step of heating the first and the second electron emitters to a temperature effective to cause an emission of electrons. Further still, the method can include the step of intermittently applying a positive voltage to the electrically distinct biasing grids relative to the cathode body thereby accelerating emitted electrons towards the target.

According to an aspect of the invention, the invention can include providing a controlled pressure of a gas within the interior volume whereby accelerated emitted electrons ionize the gas thereby forming a plasma. Further, including the step of disposing a first extraction electrode having a first aperture and a second extraction electrode, having a second aperture on opposing sides of the interior volume each between one of the first and the second electron emitters and a target. Further, the method may include the step of applying a negative voltage relative to the plasma to one of the first extraction electrode and the second extraction electrode thereby accelerate ions within the plasma through an associated aperture to the target enabling neutron production. It is possible the method can include the step of applying a positive voltage relative to the plasma to one of the first extraction electrode and the second extraction electrode thereby confining ions within the plasma in a region defined by the first extraction electrode and the second extraction electrode inhibiting neutron production.

It is noted that the term an electrically distinct biasing electrode is a broader term than an electrically distinct biasing grid, such that as more slits are introduced to the electrode the more it becomes grid-like.

The details of one or more embodiments of the invention are set forth in the accompanying drawings and the description below. Other features, objects and advantages of the invention will be apparent from the description and drawings, and from the claims.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PREFERRED EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice. Further, like reference numbers and designations in the various drawings indicated like elements.

According to an embodiment of the invention, the invention can include a multi-directional dispenser cathode having a body that supports a plurality of electron emitters each spanning open portions of the cathode body. Each electron emitter can have an inward facing surface and an outward facing surface where the inward facing surfaces and an interior wall of the body define an interior volume that contains a heater. To selectively accelerate emitted electrons, an electrically distinct biasing electrode, for example a grid (or biasing grid), can be in spaced relationship to the outward facing surface of each electron emitter and coupled to a biasing power supply effective to provide an intermittent (when pulsed is desired) positive voltage potential, relative to the cathode, to the biasing grid. The distinct biasing grids can be provided with the positive voltage potential at different times thereby causing an intermittent burst of electrons that is also independently spatially directed.

Figure 1:
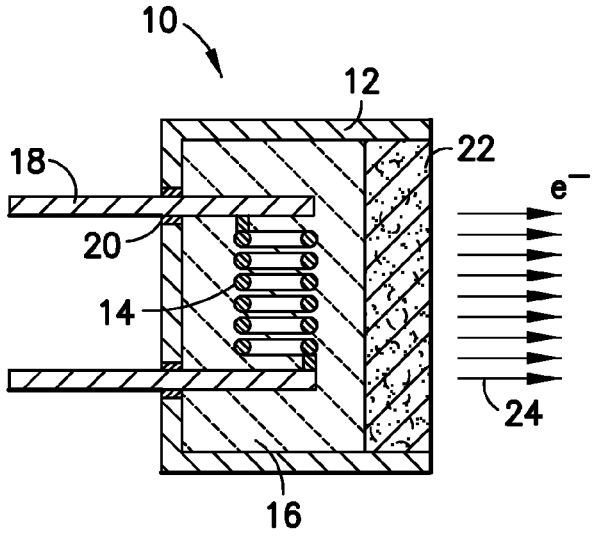
FIG. 1 PRIOR ART
FIG. 1 illustrates a uni-directional dispenser cathode as known from the prior art.

FIG. 1 shows in cross-sectional representation a uni-directional dispenser cathode 10 as known from the prior art. The dispenser cathode 10 has a body 12 that can be generally cylindrical or can-shaped. The body 12 can be formed from a metal that resists deformation at high temperatures, such as a refractory metal, and is preferably molybdenum. A heater coil 14 is inserted into a central portion of the body 12 and embedded in a ceramic matrix 16 formed from an electrically insulating material such as ceramic. Leads 18 extend through a wall of the body 12 and are electrically isolated from the body by dielectric 20. The leads 18 are electrically interconnected to a power supply capable of providing a current effective for the heater coil 14 to reach an effective elevated temperature on the order of approximately 900° C. or more.

Still referring to FIG. 1, shows sealing an open end of body 12 that is emitter 22 formed from a material or composite that resists deformation at elevated temperatures and readily emits electrons 24 when exposed to elevated temperatures. Typically, emitter 22 can be porous tungsten with a work function lowered by a suitable dopant, such as barium calcium aluminate.

Figure 2:
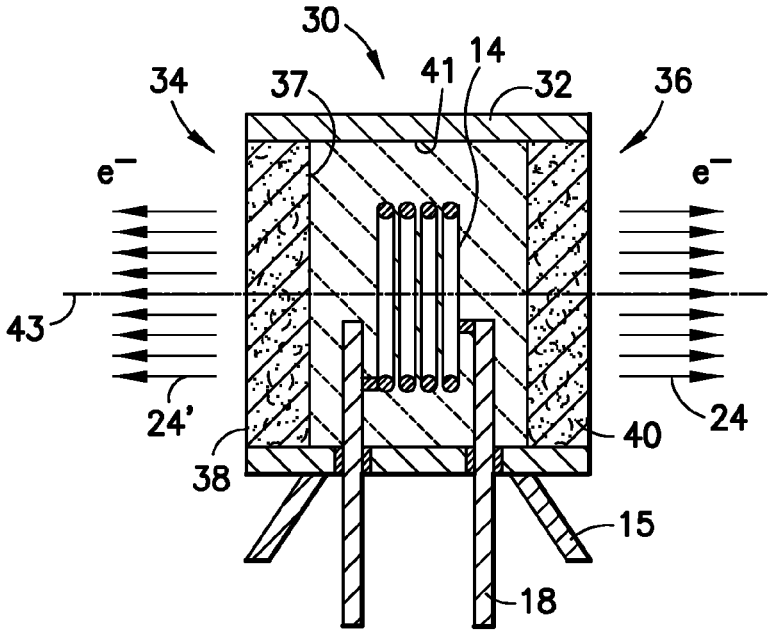
FIG. 2 illustrates in cross-sectional representation a bi-directional dispenser cathode according to an embodiment of the invention.

FIG. 2 illustrates in cross-sectional representation a bi-directional dispenser cathode 30. The dispenser cathode 30 has a body 32 that can be open at least at a first end 34 and a second end 36. Leads 18 extend through a wall of the body 32 to provide power to heater coil 14. Support legs 15 that may be fastened to a wall or other support structure inside a Betatron vacuum chamber, or other radiation generating device, so as to position the bi-directional dispenser cathode 30. An electrically conductive support leg may function as a current return and replace one of the leads 18, provided that the lead contacts an electrically conductive surface of the body. A first electron emitter 38 spans the first open end 34 and a second emitter 40 spans the second open end 36, such that inward facing surfaces 37 of the electron emitters and interior walls 41 of the body define an interior volume that contains the heater coil 14. As described above, the first and second emitters can be formed from a material that when heated to an elevated temperature emits electrons 24, 24'. When the first emitter 38 and second emitter 40 are porous tungsten doped with a material effective to lower the work function, such as barium-calcium-aluminate, the emitter is heated to a temperature of approximately 900° C. or higher. The current required to power the coil 14 is dependent on factors such as heater wire resistance, emitter material and desired temperature. Usually, a current of between 1 amp and 2.5 amps is effective to generate the required temperature when the heater wire is formed from tungsten or a rhenium tungsten alloy.

Figure 8:
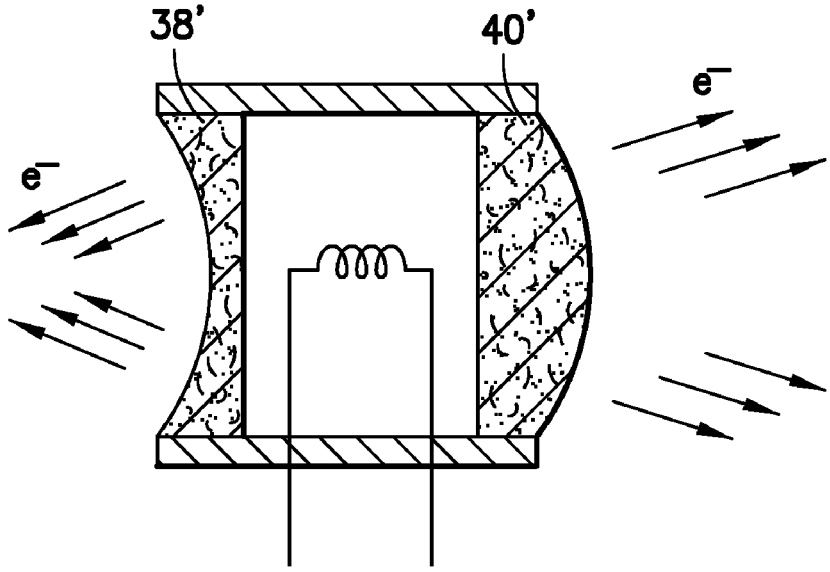
FIG. 8 illustrates an alternative configuration for the electron emitters of a bi-directional dispenser cathode.
Figure 9:
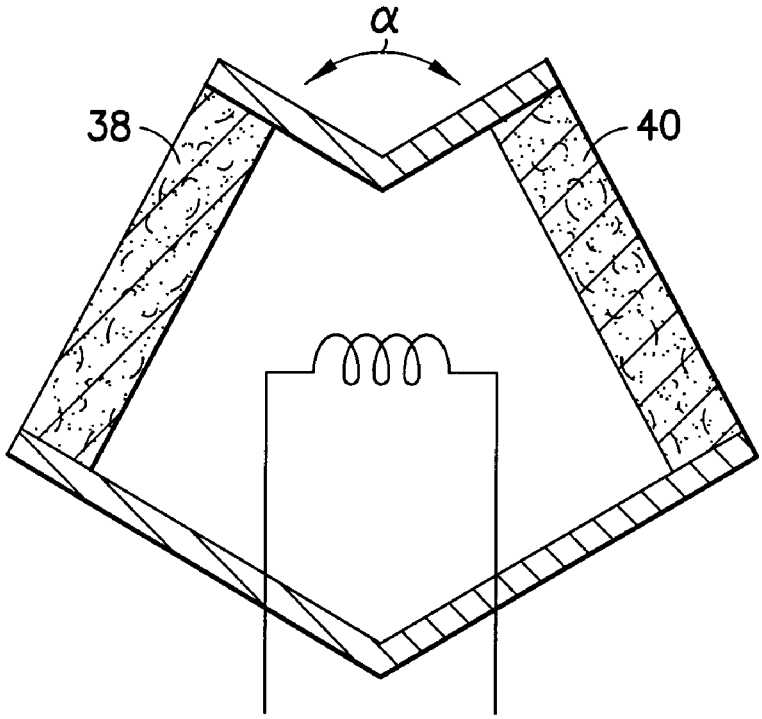
FIG. 9 illustrates another alternative configuration for the electron emitters of a bi-directional dispenser cathode.
Figure 10:
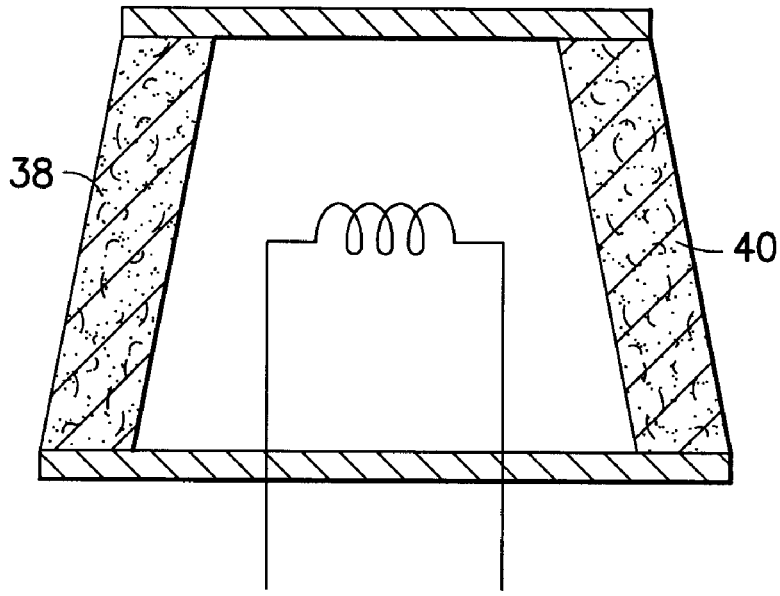
FIG. 10 illustrates yet another alternative configuration for the electron emitters of a bi-directional dispenser cathode.

Still referring to FIG. 2, the electron emitters 38, 40 can be disposed along longitudinal axis 43 of the bi-directional dispenser cathode 30 and can be for example oriented by 180 degrees apart (i.e. oppositely oriented). Although other electron emitter 38, 40 configurations may be utilized. As non-limiting examples, an electron emitter 38' may be concave or the electron emitter 40' may be convex as shown in FIG. 8 and provide focusing or defocusing as desired. The angle, $\alpha$, between electron emitter 38 and electron emitter 40 may be less than 180° as shown in FIG. 9. The electron emitters 38, 40 may be disposed at an angle other than perpendicular to the longitudinal axis 43 as shown in FIG. 10.

Figure 3:
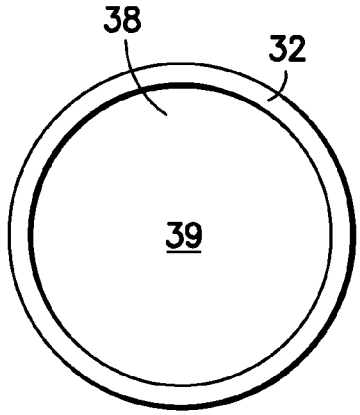
FIG. 3 illustrates the bi-directional dispenser cathode of FIG. 2 in front planar view.

As shown in FIG. 3, the bi-directional dispenser cathode has planar faces formed from an outward facing surface 39 of a disk, square or other desired shape of either the first emitter 38 or second emitter 40 supported within the inner bore of body 32. While both the first emitter 38 and second emitter 40 are heated to a temperature effective to emit electrons, the power requirements of the heater coil may be less than double that of a prior art uni-directional dispenser cathode because of the small size and proximity of the heater wire to both emitters.

Figure 4:
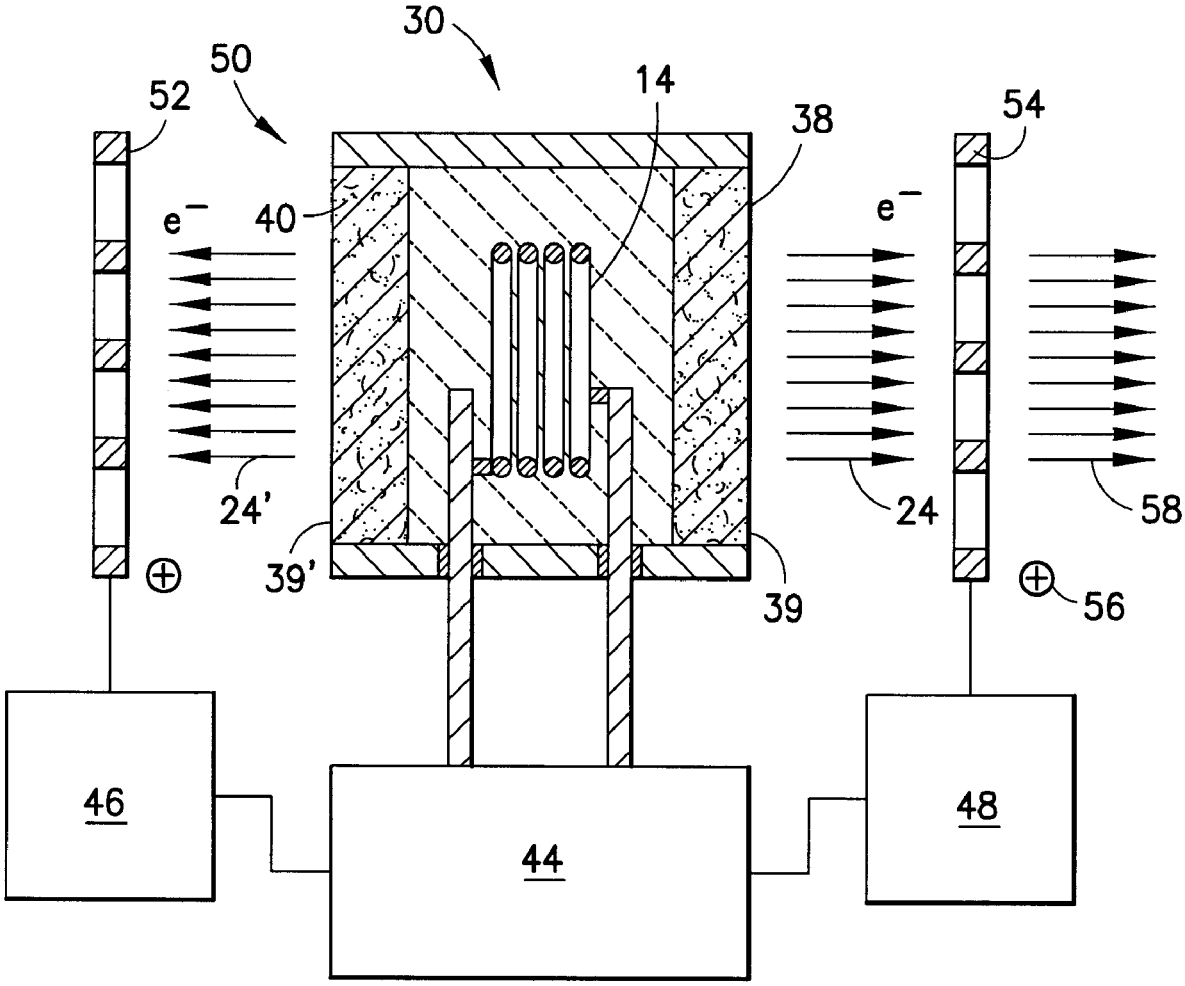
FIG. 4 illustrates a system utilizing the bi-directional dispenser cathode of FIG. 2 to deliver selective bursts of electrons according to an embodiment of the invention.

Referring back to FIG. 2, electrons 24, 24' are continuously emitted from both the first emitter 38 and second emitter 40. To generate pulses of electrons and to control the directionality of the electron pulses, a particle accelerating system 50 utilizing the bi-directional dispenser cathode 30 as illustrated in FIG. 4 may be utilized to deliver selective bursts of electrons. A bi-directional dispenser cathode power supply 44 supplies sufficient current to heater coil 14 to maintain the first emitter 38 and the second emitter 40 at temperatures effective to emit electrons 24, 24'. A biasing voltage is provided by a first grid biasing power supply 46 and a second grid biasing power supply 48. The first grid biasing power supply 46 is electrically coupled to a first biasing grid 52 and the second grid biasing power supply 48 is electrically coupled to a second biasing grid 54. Each biasing grid is electrically distinct, that is electrically isolated from the other biasing grids. Each biasing grid is also spaced from each outward facing surface 39, 39' of each electron emitter 38. When one of the first biasing grid 52 and second biasing grid 54 is provided with a positive voltage potential 56 with respect to the cathode 30, the electrons 24, 24' are accelerated and pass through that biasing grid 52, 54.

Again, referring to FIG. 4, the first biasing grid 52 and second biasing grid 54 may be pulsed to a positive potential, such as by a switch, to provide intermittent pulses of accelerated electrons 58 at desired times from one or both sides of the bi-directional dispenser cathode 30. Typically, the pulses of positive voltage potential are synchronized with a detection component of the tool such that pulses of electrons are directed to a target at a specific time for x-ray generation or into an ion source plasma volume for neutron generation.

Figure 5:
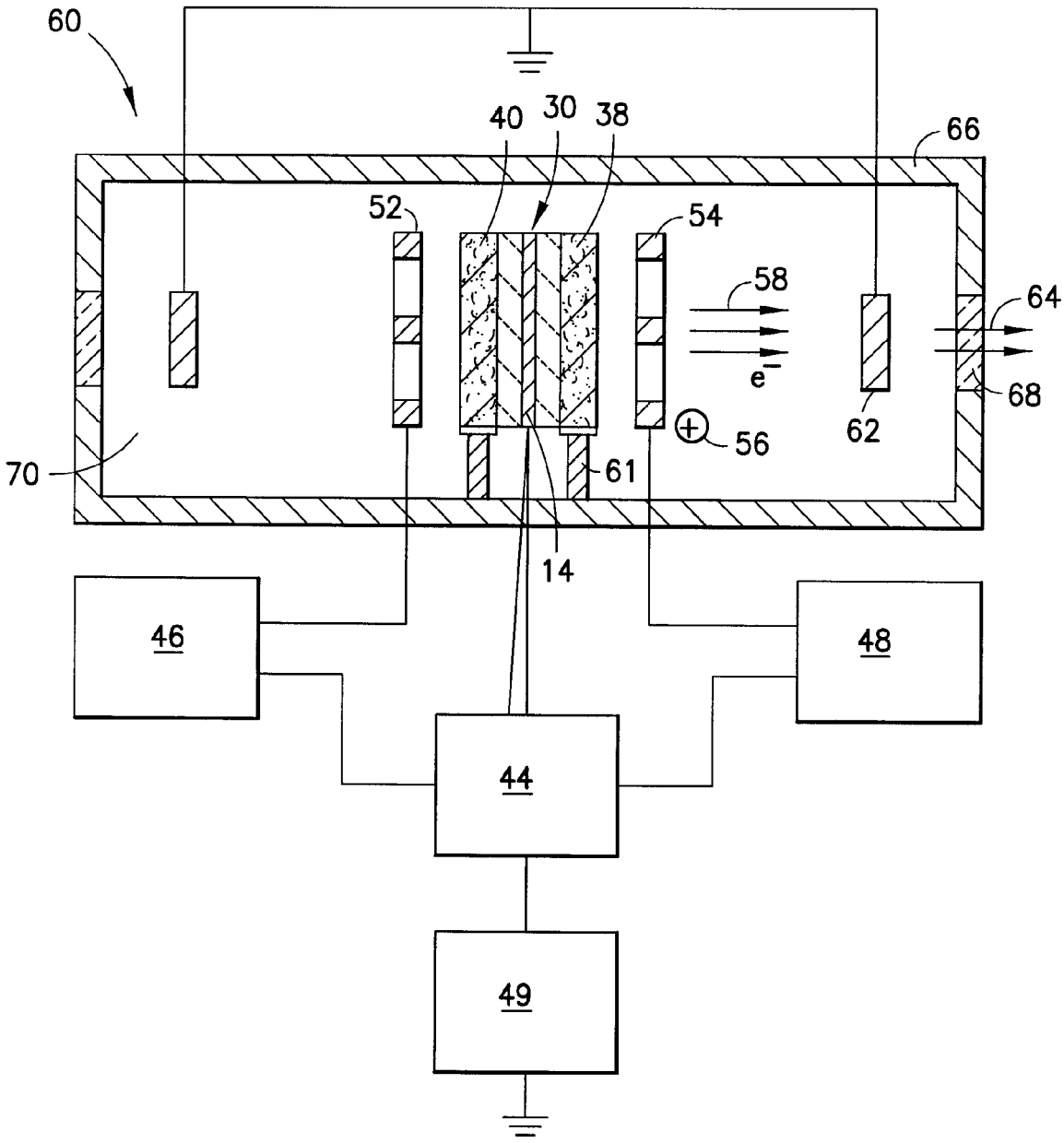
FIG. 5 illustrates a system utilizing the bi-directional dispenser cathode of FIG. 2 to deliver selective bursts of x-rays according to an embodiment of the invention.

FIG. 5 illustrates a system 60 utilizing the bi-directional dispenser cathode 30 to deliver selective bursts of x-rays. Bi-directional cathode 30 is aligned and supported, such as by support legs 61. Bi-directional cathode power supply 44 provides power to heater coil 14 that elevates the temperatures of first emitter 38 and second emitter 40 to a temperature effective to emit electrons. Powered by main power supply 49, one or both of the first grid biasing power supply 46 and second grid biasing power supply 48 imposes a voltage potential 56, relative to the cathode 30, on a respective biasing grid 52, 54. A positive potential allows accelerated electrons to pass through the biasing grid. A negative potential inhibits the flow of electrons. Accelerated electrons 58 strike a target 62 that emits x-rays 64 following impact. Any suitable material may be used for the target, such as tungsten foil. Body 66 includes an x-ray transparent window 68, such as tin foil, enabling the x-rays to exit while interior volume 70 is maintained at a suitable vacuum. The emitted x-rays 64 are then used to image a living body, determine density of an earth formation, or any other desired application.

Figure 6:
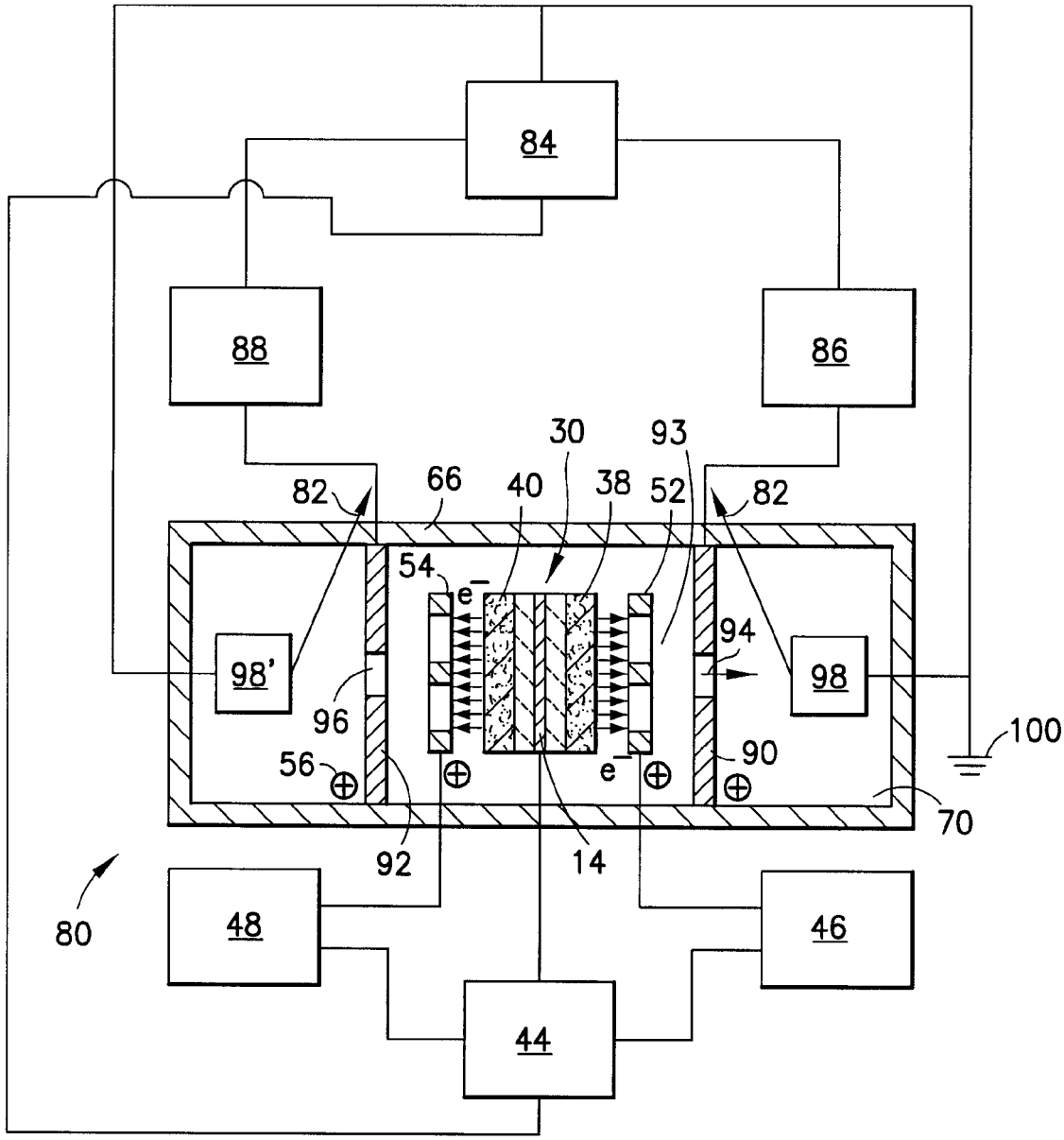
FIG. 6 illustrates as system utilizing the bi-directional dispenser cathode of FIG. 2 to deliver selective bursts of neutrons according to an embodiment of the invention.

FIG. 6 illustrates a system 80 utilizing the bi-directional dispenser cathode 30 in a multiple point source grounded target neutron generator that delivers selective bursts of neutrons 82. The interior volume 70 within the body 66 of system 80 contains a low partial pressure of a selected gas. The gas is selected to form a plasma when ionized by a pulsing source of energized electrons. Suitable gases include deuterium and/or tritium at a partial pressure of a few millitorr (e.g. 1-100 mTorr). As previously described, the floating at high voltage bi-directional cathode power supply 44 provides current to heater coil 14 effective to heat first electron emitter 38 and second electron emitter 40 to a temperature sufficient to lead to an emission of electrons. One or both of the first grid biasing power supply 46 and a second grid biasing power supply 48 supply a positive voltage potential 56, relative to the cathode 30, to one or both of first biasing grid 52 and second biasing grid 54 independently, in time and/or duration, accelerating electrons that ionize the plasma forming gas in a region 93 between the biasing grid and first extraction electrode 90 and second extraction electrode 92.

A high voltage power supply 84, that may be a separate unit or the same unit as bi-directional cathode power supply 44, provides a high voltage to a first extraction biasing power supply 86 and second extraction biasing power supply 88. The extraction biasing power supplies provide a voltage potential to one or both of first extraction electrode 90 and second extraction electrode 92 effective to float the extraction electrodes relative to the plasma. The plasma is shaped into an efficient beam by window 94, 96 and impacts neutron generating target 98. Target 98, which contains a metal hydride, such as Ti-hydride, is the site of a neutron producing fusion reaction.

In the grounded target neutron generator 80, the ion source and its supply electronics 44, 46, 48 are floated at high positive potential while the target 98 is at ground 100 potential. Since the significant technical challenge lies in floating the necessary ion source power supplies, it becomes attractive to improve the measurement capability (utility) of the neutron generator by creating accelerated ions 94 in distinct opposite directions directed at separate grounded targets 98, 98'. By employing a bi-directional cathode 30, essentially located in sealed body 66, with two grounded targets 98, 98', at opposite ends, and by making use of independent grid pulse biasing, neutrons can be obtained from distinct locations making this device a dual point source grounded target neutron generator.

Alternative neutron generator configurations have the targets at a high negative voltage potential relative to ground and the ion source at or near ground.

High voltages require special power supplies and insulation. In another alternative, the target and the ion source may both be at some intermediate voltage potential relative to ground, but of different polarities such that the voltage potential between the ion source and the targets is high without the need for excessive high voltage components and associated electrical insulation.

Alternatively, rather than pulsing biasing grids 52,54, extraction electrodes 90,92 may be pulsed to extract or confine the plasma, or a combination of the biasing grids and extraction electrodes are selectively energized for extraction and confinement. In this embodiment, pulsing the extraction electrodes with a positive potential, relative to the plasma, would suppress the extraction of ions from the plasma into a beam. Pulsing the extraction electrodes to the same potential or negative relative to the plasma, enhances the extraction of ions from the plasma into the beam.

Figure 7:
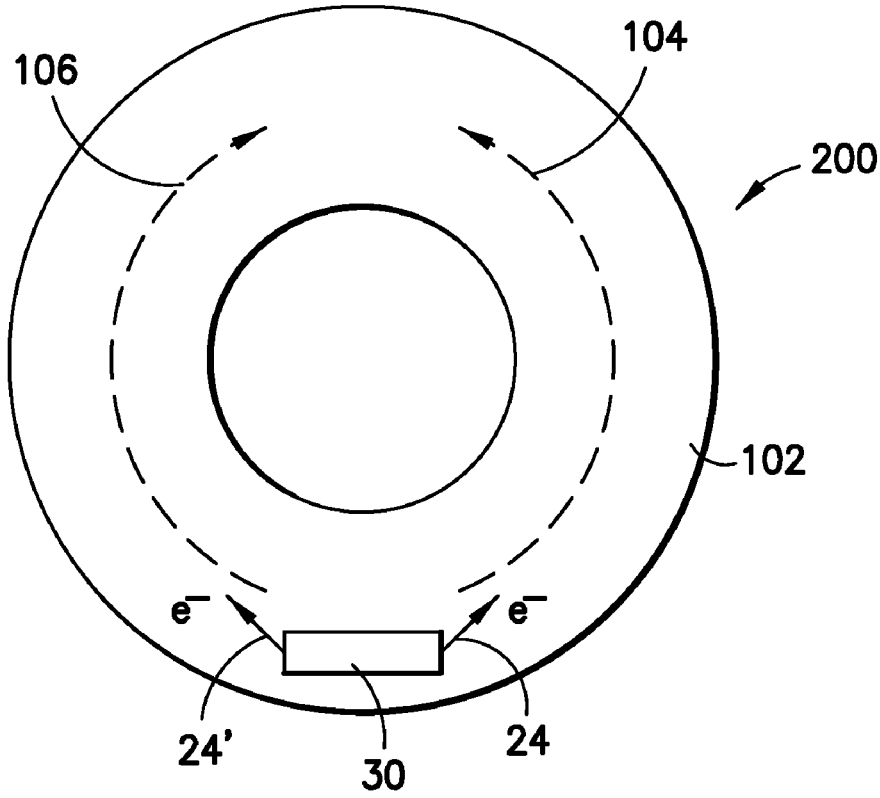
FIG. 7 illustrates the system of FIG. 5 as an electron source for a Betatron according to an embodiment of the invention.

FIG. 7 illustrates a portion 200 of a Betatron utilizing the bi-directional dispenser cathode 30. The Betatron includes an evacuated toroidal passageway 102 that passes through a changing magnetic field. Electrons 24, 24' injected into the passageway 102 are accelerated along a main electron orbit in a first direction 104 as an increasing positive voltage generates the magnetic field followed by being accelerated along the main electron orbit in an opposing second direction 106 as an increasing negative voltage generates the magnetic field. Typically, an AC power supply provides the voltage generating the magnetic field such that the first portion of each cycle accelerates in first direction 104 and a second portion of each cycle accelerates in direction 106. At an optimal/desired time, the electrons are deflected from the main electron orbit and impact a target, such as a tungsten foil, to generate x-rays.

Each separate stream of electrons 24, 24' can be accelerated in the cyclical field of the Betatron based particle accelerator with suitably timed pulse bias to be emitted during the proper portion of the acceleration cycle. The Betatron operates by appropriately ramping a magnetic field about an evacuated toroidal structure periodically filled with electrons. The electrons are injected from the bi-directional dispenser cathode 30 with some appropriate energy and are subsequently trapped into orbits dictated by the applied magnetic field. Relatively large currents are typically needed to generated the requisite magnetic field. For efficiency reasons, among others, a tank circuit is employed whereby energy oscillates between capacitive and inductive components, the later of which includes electro magnetic coils which generate the magnetic field. In this scenario, as the energy oscillates, the alternating current induces an alternating magnetic field, reversing direction on every half cycle. By employing the bi-direction dispenser cathode 30 in such a driven Betatron, and appropriately timing the pulses biasing of each face of the dispenser cathode 30, electrons 24, 24' can be injected into the accelerating and confining magnetic field for each half cycle. This in effect, doubles the radiative efficiency of the device by making full use of each part of the operating cycle.

One or more embodiments of the present invention have been described. Nevertheless, it will be understood that various modifications may be made without departing from the spirit and scope of the invention. For example there may be more than two electron emitting surfaces forming a multi-directional dispenser cathode. Further, the faces of the electron emitting surfaces need not be planar, but may take other configurations to affect the emittance of the accelerated electrons. Accordingly, other embodiments are within the scope of the following claims. Further, it is noted that the foregoing examples have been provided merely for the purpose of explanation and are in no way to be construed as limiting of the present invention. While the present invention has been described with reference to an exemplary embodiment, it is understood that the words, which have been used herein, are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A multi-directional dispenser cathode, comprising:

a cathode body supporting a plurality of emitters spanning open portions of said cathode body, each of said plurality of electron emitters having an inward facing surface and an outward facing surface wherein said inward facing surfaces and an interior wall of said cathode body define an interior volume; and a heater contained within said interior volume.

2. The multi-directional dispenser cathode of claim 1, wherein a first electrically distinct biasing electrode is in spaced relationship to an outward facing surface of a first electron emitter of said plurality of electron emitters and a second electrically distinct biasing electrode is in spaced relationship to an outward facing surface of a second electron emitter of said plurality of electron emitters.

3. The multi-directional dispenser cathode of claim 2, wherein said first electrically distinct biasing electrode is coupled to at least one biasing power supply and said second electrically distinct biasing electrode is coupled to at least one other biasing power supply, so as to be effective to provide a positive voltage potential, relative to said cathode body to the respective said first and said second electrically distinct biasing electrodes.

4. The multi-directional dispenser cathode of claim 3, wherein a switch coupled to one of said at least one biasing power supply and said at least one other biasing power supply is effective to cause said positive voltage potential to be intermittently provided to one of said first and said second electrically distinct biasing electrode.

5. The multi-directional dispenser cathode of claim 4, wherein said first and said second electrically distinct biasing electrodes are provided with said positive voltage potential at different times.

6. The multi-directional dispenser cathode of claim 5, wherein the multi-directional dispenser cathode has two electron emitters.

7. The multi-directional dispenser cathode of claim 6, wherein said first and said second electron emitters are disposed along a longitudinal axis of said cathode body.

8. The multi-directional dispenser cathode of claim 5, wherein said heater is a metal coil that repeatedly heats to a temperature of approximately 900° C. or more when an effective electric current passes therethrough.

9. The multi-directional dispenser cathode of claim 8, wherein at least one of said plurality of electron emitters is a porous tungsten matrix doped with a low work function material.

10. The multi-directional dispenser cathode of claim 8, wherein said metal coil receives said effective electric current through leads that extend through said cathode body, said cathode body being a refractory metal and electrically isolated from said leads by a dielectric.

11. A Betatron having a passageway disposed in a cyclical magnetic field, said Betatron comprising:

a dispenser cathode disposed within the passageway having a plurality of electron emitters, each one of the plurality of electron emitters having a respective outward-facing surface; and a plurality of targets effective to generate x-rays when impacted by accelerated electrons, each outward-facing surface of the plurality of electron emitters facing a respective one of the plurality of targets.

12. The Betatron of claim 11, wherein said dispenser cathode includes a first electrically distinct biasing grid in spaced relationship to an outward facing surface of a first electron emitter of said plurality of electron emitters and a second electrically distinct biasing grid in spaced relationship to an outward facing surface of a second electron emitter of said plurality of electron emitters, such that said first and said second electrically distinct biasing grids are each coupled to a biasing power supply effective to provide a positive voltage potential relative to said cathode body to the respective said first and said second electrically distinct biasing grids; and a switch coupled to said biasing power supply effective to cause said positive voltage potential to be intermittently provided to each of said first and said second electrically distinct biasing grids.

13. The Betatron of claim 12, wherein said dispenser cathode has two electron emitters disposed along a longitudinal axis of said cathode body.

14. The Betatron of claim 13, wherein said switch is synchronized with said cyclical magnetic field whereby electrons generated from said first electron emitter are accelerated into said passageway during an increasing positive portion of said cyclical magnetic field and electrons generated from said second electron emitter are accelerated into said passageway during an increasing negative portion of said cyclical magnetic field.

15. A particle accelerator, comprising:

a body defining an interior volume;

a dispenser cathode disposed within a passageway having a plurality of electron emitters, each one of the plurality of electron emitters having a respective outward-facing surface; and a plurality of targets, each effective to generate at least one product when impacted by accelerated particles, each outward-facing surface of the plurality of electron emitters facing a respective one of the plurality of targets.

16. The particle accelerator of claim 15, wherein said dispenser cathode includes:

a first electrically distinct biasing electrode in spaced relationship to an outward facing surface of a first electron emitter of said plurality of electron emitters and a second electrically distinct biasing electrode in spaced relationship to an outward facing surface of a second electron emitter of said plurality of electron emitters, such that each of said first and said second electrically distinct biasing electrodes are coupled to a floating high voltage biasing power supply effective to provide a positive voltage potential relative to said cathode body to the respective said first and said second electrically distinct biasing electrodes; and a switch coupled to said biasing power supply effective to cause said positive voltage potential to be intermittently provided to each of said first and said second electrically distinct biasing electrodes.

17. The particle accelerator of claim 16, wherein said dispenser cathode has two electron emitters disposed along a longitudinal axis of said cathode body.

18. The particle accelerator of claim 17, wherein said target is effective to emit x-rays when impacted by accelerated electrons.

19. The particle accelerator of claim 17, wherein said interior volume contains a gas.

20. The particle accelerator of claim 19, wherein said target is effective to emit neutrons when impacted by accelerated ions.

21. A method for the operation of a Betatron, comprising the steps of:

providing a Betatron having a passageway disposed in a cyclical magnetic field, with a dispenser cathode having a first electron emitter and a second electron emitter of a plurality of electron emitters disposed within said passageway, an electrically distinct biasing grid in spaced relationship to an outward facing surface of each of said first and said section electron emitters, and a target effective to generate x-rays when impacted by accelerated electrons;

heating said first and said second electron emitters to a temperature effective to cause an emission of electrons; and intermittently applying a positive voltage relative to said cathode body to said electrically distinct biasing grids thereby accelerating emitted electrons.

22. The method of claim 21, wherein said step of intermittently applying said positive voltage is synchronized with said cyclical magnetic field.

23. The method of claim 22, wherein said synchronization causes electrons generated from said first electron emitter to be accelerated into said passageway during an increasing positive portion of said cyclical magnetic field and electrons generated from said second electron emitter to be accelerated into said passageway during an increasing negative portion of said cyclical magnetic field.

24. A method for the operation of a particle accelerator, comprising the steps of:

providing a particle accelerator body having an interior volume a dispenser cathode having a first and a second electron emitter disposed within said interior volume, an electrically distinct biasing grid in spaced relationship to an outward facing surface of each of said first and said second electron emitter, and a target effective to generate at least one product when impacted by accelerated particles;

heating said first and said second electron emitters to a temperature effective to cause an emission of electrons; and intermittently applying a positive voltage to said electrically distinct biasing grids relative to said cathode body thereby accelerating emitted electrons towards said target.

25. The method of claim 24, including providing a controlled pressure of a gas within said interior volume whereby accelerated emitted electrons ionize said gas thereby forming a plasma.

26. The method of claim 25, including the step of disposing a first extraction electrode having a first aperture and a second extraction electrode having a second aperture on opposing sides of said interior volume each between one of said first and said second electron emitters and a target.

27. The method of claim 26, including the step of applying a negative voltage relative to said plasma to one of said first extraction electrode and said second extraction electrode thereby accelerate ions within said plasma through an associated aperture to said target enabling neutron production.

28. The method of claim 26, including the step of applying a positive voltage relative to said plasma to one of said first extraction electrode and said second extraction electrode thereby confining ions within said plasma in a region defined by said first extraction electrode and said second extraction electrode inhibiting neutron production.

* * * * *